United States Patent [19]

Wittmann et al.

[11] Patent Number: 4,907,353

[45] Date of Patent: Mar. 13, 1990

[54] CROSS-COUNTRY SKI BOOT

[75] Inventors: Heinz Wittmann; Karl Stritzl, both of Vienna; Franz Luschnig, Traiskirchen; Robert Stanzl, Enzersdorf/Fischa; Alois Himmetsberger, Vienna, all of Austria

[73] Assignee: TMC Corporation, Switzerland

[21] Appl. No.: 230,834

[22] PCT Filed: Nov. 11, 1987

[86] PCT No.: PCT/EP87/00695

§ 371 Date: Jul. 13, 1988

§ 102(e) Date: Jul. 13, 1988

[87] PCT Pub. No.: WO88/05271

PCT Pub. Date: Jul. 28, 1988

[30] Foreign Application Priority Data

Jan. 23, 1987 [AU] Australia ..... 129/87

[51] Int. Cl.[4] ..... A43B 5/04; A63C 9/00

[52] U.S. Cl. ..... 36/117; 280/615

[58] Field of Search ..... 36/117-121; 280/615

[56] References Cited

U.S. PATENT DOCUMENTS

| | | | |
|---|---|---|---|
| 4,334,367 | 6/1982 | Salomon | 36/117 |
| 4,382,611 | 5/1983 | Salomon | 280/615 |

FOREIGN PATENT DOCUMENTS

| | | | |
|---|---|---|---|
| 0029206 | 5/1981 | European Pat. Off. | 36/117 |
| 2803552 | 8/1979 | Fed. Rep. of Germany | 36/117 |
| 2942806 | 9/1985 | Fed. Rep. of Germany . | |
| 2443814 | 7/1980 | France . | |
| 2533421 | 3/1984 | France . | |
| 2556569 | 6/1985 | France | 36/117 |

*Primary Examiner*—James Kee Chi

*Attorney, Agent, or Firm*—Finnegan, Henderson, Farabow, Garrett & Dunner

[57] ABSTRACT

A cross-country ski boot sole having a toe end and heel end, the sole comprising a first section including a portion substantially disposed at the toe-end of the sole, the first section formed of hard plastic, a second section substantially formed of plastic material softer than the first section, connecting surfaces connecting the first section and the second section, a hook disposed in and extending from the toe end of the first section for engagement with a cross-country ski binding, and support surfaces disposed on the periphery of the sole for interaction with a cross-country ski binding.

11 Claims, 3 Drawing Sheets

CROSS-COUNTRY SKI BOOT

BACKGROUND OF THE INVENTION

1. Field of the Invention

The invention relates to a cross-country ski boot.

2. Description of the Related Art

A cross-country ski boot is described, for example, in German Patent Specification 2,942,806. In this known cross-country ski boot, the supporting surface is located at the front end of the gliding sole. Furthermore, a retaining element bent from wire is anchored (injection-molded) directly in the gliding sole of the cross-country ski boot. Such an arrangement is used in the trade, but is practicable only when the material of the gliding sole has sufficient strength. However, a softer (more elastic) sole is often desired in cross-country ski boots for leisure skiers. Such a soft gliding sole does not have the necessary tearing strength for directly anchoring the hooking element.

It has therefore already been proposed (see German Offenlegungsschrift 3,334,144) to fasten the hooking element to a metal plate-shaped insert, and anchor (injection-mold) it in the gliding sole together with the hooking element. However, the disadvantage of this known solution is that the metal insert constitutes a foreign body in the plastic gliding sole. When the foot rolls, stresses may occur which can lead to the formation of splits and cracks especially at the edges of the insert. Moreover, in this known cross-country ski boot, the supporting surface interacting with the ski tie is also composed of the (soft) sole material, thus resulting in its premature wear.

It may be mentioned, merely for the sake of completeness, that, in current products, the part intended for engaging into the ski binding is itself composed of hard plastic and is injection-molded into the boot sole. However, this is a different type of cross-country ski boot, since there is no hooking element made of bent wire.

The object of the present invention is to avoid the disadvantages of the known cross-country ski boots and provide a cross-country ski boot in which the gliding sole is highly pliable, but the hooking element can nevertheless be anchored reliably in the gliding sole, without the rolling movement of the foot being impeded thereby. Furthermore, the portion carrying the hooking element will be connected permanently to the remaining portion of the gliding sole.

SUMMARY OF THE INVENTION

According to the invention, this object is achieved by a cross-country ski boot sole having a toe end and a heel end, the sole including a first section having a portion substantially disposed at the toe-end of the sole, the first section formed of hard plastic, a second section substantially formed of plastic material softer than the first section, a connecting portion for connecting the first section and the second section, a hook disposed in and extending from the toe end of the first section for engagement with the binding of a cross-country ski, and a support surface disposed on the periphery of the sole for interaction with a cross-country ski binding. As a result of this measure, it is possible to securely anchor a hooking element composed of multiply angled wire, even in a soft elastic gliding sole, without impairing the pliability of the gliding sole.

A long lifetime of the parts of the gliding sole which interact with the ski binding is achieved, in part, by means of the support surfaces disposed on either side of the hooking element.

The effective contact surface between the two portions of the gliding sole is increased as a result of the unique contact surfaces between the first and second sections of the sole.

Less resistance is opposed to a rolling movement of the cross-country boot, in part, by means of the tapered shape of the first section of the sole.

The extensions of the first section surrounding the second section make it possible to protect the gliding sole against premature wear on its periphery.

Finally, the webbing increases the stability of the gliding sole in the transverse direction, while retaining the longitudinal elasticity necessary for rolling.

Further advantages, features and details of the cross-country ski boot according to the invention are described in detail with reference to the drawings.

FIG. 1 shows a side view of the cross-country ski boot in accordance with the present invention FIGS. 2 to 7 show four different embodiments of the front region of the gliding sole of the cross-country ski boot in a plan view and in a longitudinal section respectively in accordance with the present invention, FIGS. 8 and 9 show a fifth embodiment of the present invention, FIG. 8 being a section along the line VIII—VIII of FIG. 9 and FIG. 9 being a section along the line IX—IX of FIG. 8;

DESCRIPTION OF THE PREFERRED EMBODIMENT

Figure 1:
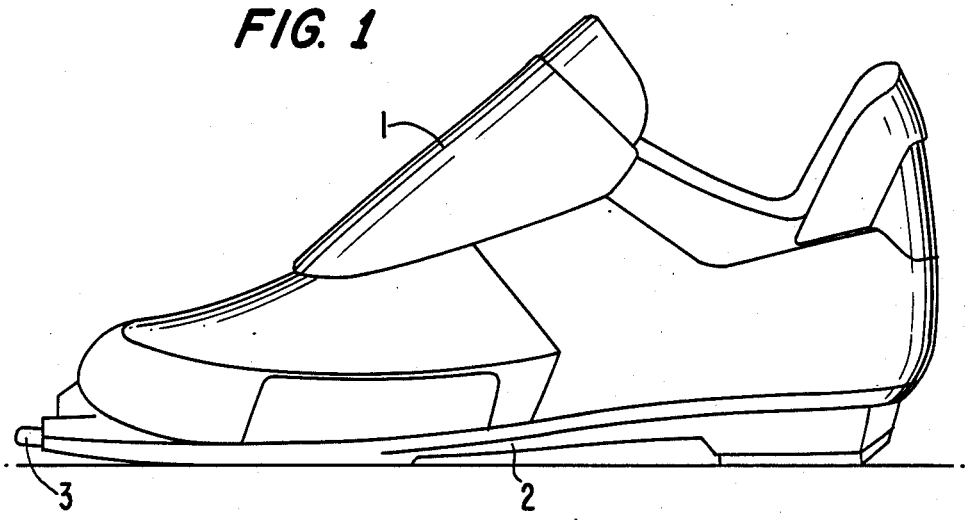

A cross-country ski boot is shown in FIG. 1. It has an upper 1, a gliding sole 2 connected to the upper 1 on its periphery, and a hooking element 3 anchored in the gliding sole 2 and formed from multiply angled wire. In the remaining Figures, the upper 1 has been omitted since it is not the subject of the invention.

Figure 2:
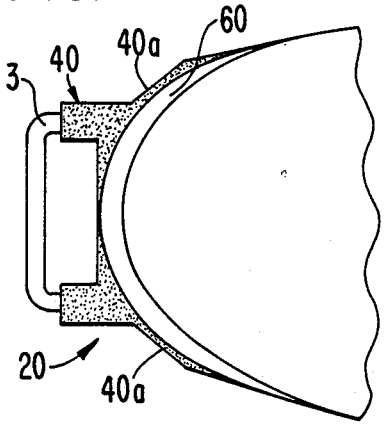
Figure 3:
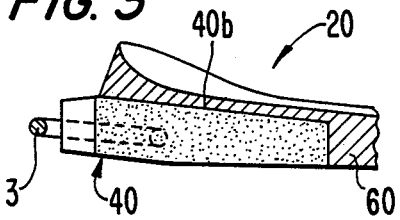

FIGS. 2 and 3 show the front region of a first embodiment of the gliding sole 20. It can be seen from these that the hooking element 3 is anchored in a first (front) section 40 of the gliding sole 20. Two supporting surfaces 40*a* provided for interaction with a cross-country ski binding (not shown) are attached to the first section 40 of the gliding sole 20. The first section 40 of the gliding sole 20 has a side 40*b* for mating with a second section 60. The first portion 40 of the gliding sole 20 is composed of a hard resistant plastic (for example, polyamide with a hardness of approximately 50–70 Shore D) and is formed in the second section 60 (partially surrounding it) of the gliding sole 20. This second section 60 of the gliding sole 20 is composed of a plastic softer and more elastic in comparison with the section 40 (for example, of thermorubber with a hardness of approximately 30–50 Shore D). As a result of the injection-molding, a firm connection is made between the first section 40 and the second portion 60 of the gliding sole 20. However, it is also possible additionally to glue the two sections 40 and 60. Because the hooking element 3 is formed in the first section 40 composed of hard plastic, a secure anchoring of the hooking element 3 is guaranteed, while at the same time the pliability of the gliding sole 20 is preserved. Also, the fact that the supporting surfaces 40*a* are provided on the first 40 results in high durability.

Figure 4:
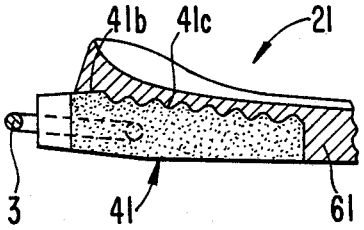
Figure 5:
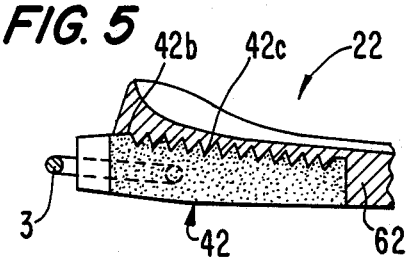

The following Figures show only those details which differ from the embodiment just described. In the embodiments according to FIGS. 4 and 5, the first section 41, 42 of the gliding sole 21, 22 has corrugations 41*c* or ribs 42*c* on the side 41*b*, 42*b* facing the second section 61, 62 and at the top in the position of use of the cross-country ski boot. This results in a larger connecting surface between the respective sections 41, 42 and 61, 62 and therefore forms an especially good bond.

Figure 6:
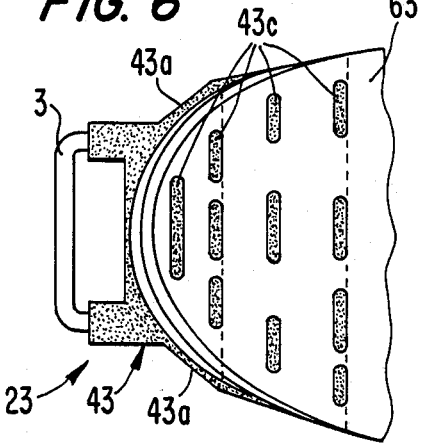
Figure 7:
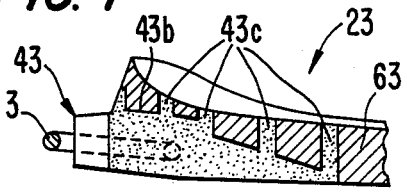

FIGS. 6 and 7 illustrate a further embodiment. Here, the first section 43 of the gliding sole 23 has, in a similar way to that described above, projections 43*c* which pass, at least in places, through the second portion 63 of the gliding sole 23. Similar to the proceding embodiments, the embodiment depicted in FIGS. 6 and 7 also includes support surfaces 43*a* disposed on either side of the hooking element. In this embodiment, the top side 43*b* of the first section 43 is inclined rearwardly and downwardly. Such a design allows a gradual (approximately wedge-shaped) transition between the first (hard) section 43 and the second (soft) section 63 of the gliding sole 23.

Figure 8:
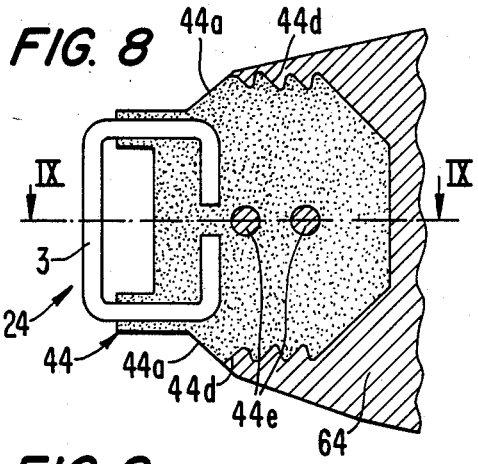
Figure 9:
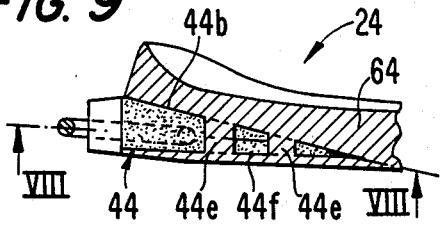

As can be seen in FIGS. 8 and 9, in the first section 44 of the gliding sole 24 there are, laterally, tooth-like projections 44*d* which, as described previously, improve the anchoring of the first section 44 in the second section 64 of the gliding sole 24. Furthermore, in this embodiment, in the region of the longitudinal mid-axis of the first section 44 of the gliding sole 24 there are bores 44*e*, through which passes the material of the second section 64 of the gliding sole 24. This embodiment also differs from that described previously in that the first section 44 is covered, on its top side 44*b* and on its underside 44*f*, by the material of the second section 64 of the gliding sole 24. However, here too, the supporting surfaces 44*a* are formed from the hard material of the first section 44.

FIGS. 10 to 14 show a further embodiment of the gliding sole 25 of the cross-country ski boot. For the sake of greater clarity, in FIGS. 10 to 13 only the front section 45 together with the hooking element 3 has been shown and the second section 65 of the gliding sole has been omitted or merely indicated.

Figure 10:
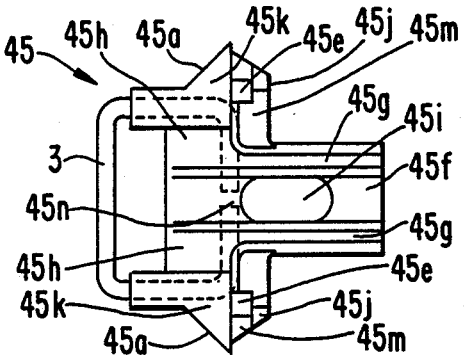
FIGS. 10 to 14 show a sixth embodiment of the first section of the gliding sole in accordance with the present invention FIG. 10 being a view from below, FIG. 11 a longitudinal section, FIG. 12 a view from above, FIG. 13 a view in the direction of the arrow A in FIG. 12 and FIG. 14 a section similar to that of FIG. 11, but in a representation showing the second section of the gliding sole.
Figure 13:
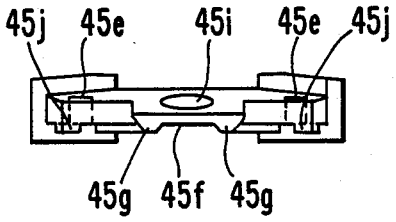
Figure 11:
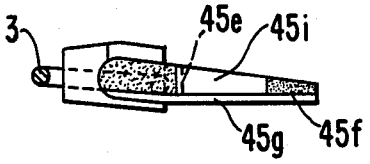
Figure 14:
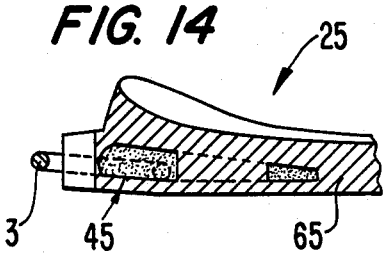
Figure 12:
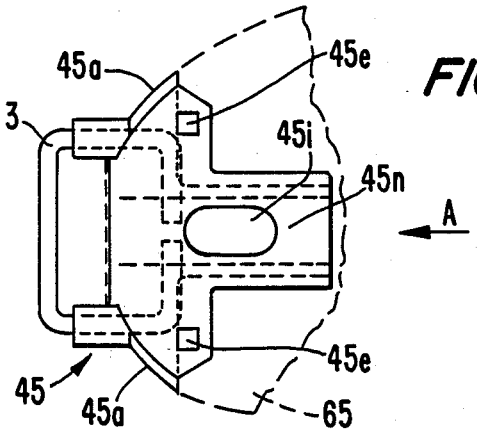

As can be seen especially in FIGS. 10 and 13, the underside 45*f* of the first section 45 has approximately V-shaped ribs 45*g* which extend in the longitudinal direction of the first section 45 symmetrically relative to the longitudinal mid-axis of the latter. Widened zones 45*h* are formed towards the side at the front ends of the ribs 45*g*. Elevated regions 45*k* extend adjacent to the widened zones 45*h* and are intended for receiving portions of the hooking element 3 which extend in the longitudinal direction. The supporting surfaces 45*a* are disposed on the outer faces of the elevated regions 45*k*. The first section 45 has, in its side regions 45*m*, perforations 45*e* and, adjacent to these, humps 45*j*. Furthermore, in the middle region 45*n* of the first section 45 there is a recess 45*i*. The material of the second section 65 of the gliding sole 25 passes through the perforations 45*e* and the recess 45*i* (see especially FIG. 14).

Figure 15:
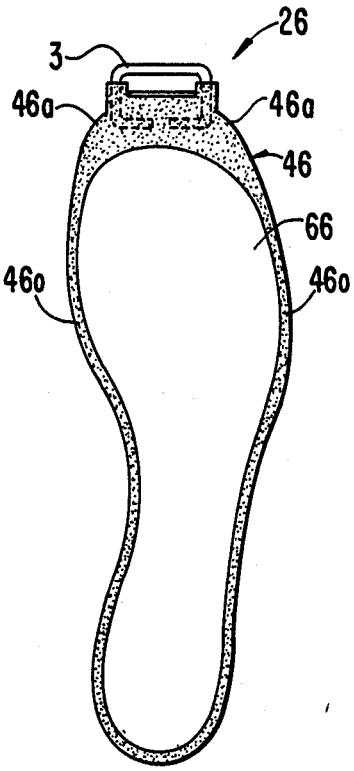
FIG. 15 depicts a seventh embodiment of the present invention in a sectional plane parallel to the underside of the sole and FIGS. 16 and 17 show an eighth embodiment of the present invention, FIG. 16 being a partial section along the line XVI—XVI of FIG. 17 and FIG. 17 being a section along the line XVII—XVII of FIG. 16.

In the embodiment illustrated in FIG. 15, the first section 46 of the gliding sole 26 is designed in such a way that segments 46*o* of the first section 46 surround the second section 66 of the gliding sole 26 on its periphery. Similar to the preceding embodiments, the embodiment depicted in FIG. 15 includes support surfaces 46*a* disposed on either side of the hooking element.

Figure 16:
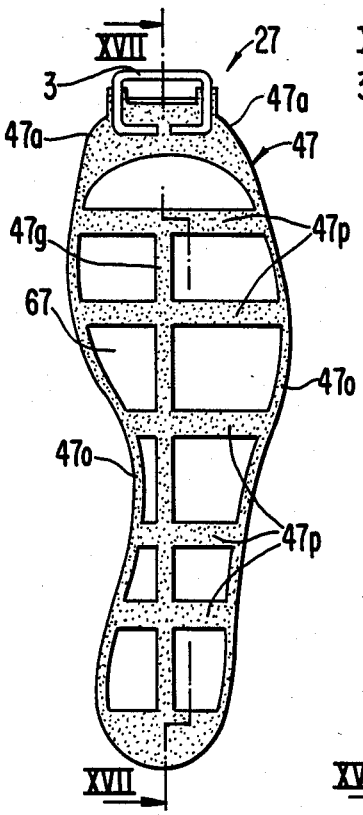
Figure 17:
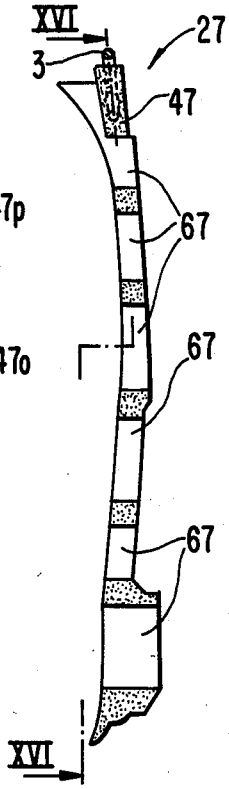

The gliding sole 27 according to FIGS. 16 and 17 is of a similar design to that just described. Here, the individual segments 47*o* of the first section 47 are connected by means of webs 47*p* which are themselves likewise connected by means of further webs 47*g* made in one piece with them. This design ensures an increased transverse rigidity of the gliding sole 27 and, at the same time, good longitudinal elasticity. Similar to the preceding embodiments, the embodiment depicted in FIGS. 16 and 17 also includes support surfaces 47*a* disposed on either side of the hooking element, and also includes second section 67.

Of course, the invention is not restricted to the embodiments illustrated and described. On the contrary, numerous modifications of these are possible, without departing from the scope of the inventive idea. Thus, in particular, combinations of the individual alternative versions are possible. It is conceivable, for example, to equip the segments of the first sole section with ribs or projections on their inner face. Furthermore, it would also be possible to make the first portion taper rearwardly in a wedge-shaped manner, but without projections. Moreover, a combination of the features listed in claims 1 to 5 is contained in the embodiment according to FIGS. 10 to 14.

We claim:

1. A cross-country ski boot sole having a toe end and heel end, the sole comprising:

a first section including a portion substantially disposed at the toe-end of the sole, the first section formed of hard plastic;

a second section substantially formed of plastic material softer than the first section;

means for connecting the first section and the second section;

hooking means disposed in and extending from the toe end of said first section for engagement with a cross-country ski binding; and support surface means disposed on the sole for interaction with a cross-country ski binding.

2. A cross-country ski boot sole according to claim 1, wherein said hooking means includes multiple angled wire anchored in said first section.

3. A cross-country ski boot sole according to claim 1, wherein said support surface means includes two support surfaces symmetrically disposed on each side of said hooking means.

4. A cross-country ski boot sole according to claim 1, wherein said connecting means includes corrugations disposed on at least one surface of the first section, said corrugations cooperating with adjoining areas of said second section to connect the first section to the second section.

5. A cross-country ski boot sole according to claim 1, wherein said connecting means includes ribs disposed on at least one surface of the first section, said ribs cooperating with adjoining areas of said second section to connect the first section to the second section.

6. A cross-country ski boot sole according to claim 1, wherein said connecting means includes projections extending from said first section into said second section for connecting the first section to the second section.

7. A cross-country ski boot sole according to claim 1, wherein said connecting means includes recesses formed in said first section for receiving portions of said second section.

8. A cross-country ski boot sole according to claim 1, wherein said first section tapers in a direction towards the heel end of the sole.

9. A cross-country ski boot sole according to claim 1, wherein the first section includes extensions surrounding the second section along the periphery of the sole.

10. A cross-country ski boot sole according to claim 9, wherein the first section includes integrally formed first webs extending in directions transverse to the edges of the sole and connecting portions of said extensions.

11. A cross-country ski boot sole according to claim 10, wherein the first section further includes integrally formed second webs extending between and connecting said first webs.

* * * * *

UNITED STATES PATENT AND TRADEMARK OFFICE

CERTIFICATE OF CORRECTION

PATENT NO. : 4,907,353

DATED : March 13, 1990

INVENTOR(S) : HEINZ WITTMANN ET AL

It is certified that error appears in the above-identified patent and that said Letters Patent is hereby corrected as shown below:

ON TITLE PAGE:

IN THE FOREIGN APPLICATION PRIORITY DATA

Change "Australia" to --Austria--.

Signed and Sealed this

Twenty-fifth Day of February, 1992

*Attest:*

*Attesting Officer*

HARRY F. MANBECK, JR.

*Commissioner of Patents and Trademarks*